US007299887B2

(12) United States Patent
Liu et al.

(10) Patent No.: US 7,299,887 B2
(45) Date of Patent: Nov. 27, 2007

(54) ROLLER BIT WITH A JOURNAL PIN OFFSET FROM THE CENTRAL AXIS THEREOF

(75) Inventors: Xuezhong Liu, Hubei Province (CN); Yan Zhao, Hubei Province (CN)

(73) Assignee: Kingdream Public Ltd. Co. (CN)

( * ) Notice: Subject to any disclaimer, the term of this patent is extended or adjusted under 35 U.S.C. 154(b) by 246 days.

(21) Appl. No.: 10/512,399

(22) PCT Filed: Mar. 26, 2003

(86) PCT No.: PCT/CN03/00220

§ 371 (c)(1),
(2), (4) Date: May 18, 2005

(87) PCT Pub. No.: WO03/091531

PCT Pub. Date: Nov. 6, 2003

(65) Prior Publication Data

US 2005/0252692 A1 Nov. 17, 2005

(30) Foreign Application Priority Data

Apr. 23, 2002 (CN) ..... 02 1 15752
Jun. 28, 2002 (CN) ..... 02 2 78185 U

(51) Int. Cl.
*E21B 10/08* (2006.01)
*E21B 10/14* (2006.01)

(52) U.S. Cl. ..... 175/376; 175/331; 175/353; 175/355

(58) Field of Classification Search ..... 175/376, 175/331, 343, 355, 55, 385, 353, 350
See application file for complete search history.

(56) References Cited

U.S. PATENT DOCUMENTS 3,367,430 A * 2/1968 Rowley ..... 175/385
3,825,083 A * 7/1974 Flarity et al. ..... 175/394
3,861,477 A * 1/1975 Lazayres ..... 175/227

(Continued)

FOREIGN PATENT DOCUMENTS

CN 2286238 Y 7/1998

(Continued)

*Primary Examiner*—Kenneth Thompson
(74) *Attorney, Agent, or Firm*—Clements Walker; Jason S. Miller

(57) ABSTRACT

This invention relates to a single cone bit with offset axis and composite cones for oil and gas drilling, mining and other subterranean drilling operations. The bit consists of a head body and a cone. The cone section has a shape of composite cones. The outer circumference of the cone is composed of from back face of the cone to top of the cone an extended gage surface, an outer cone surface and a main cone surface. A plurality of cutting elements is mounted onto each cone surface. A head journal at lower end of the head body is for rotatablely connection with the cone. Between the axis of head journal and the axis of the bit, there is an offset value d along rotating direction of the cone. A gage pad is arranged on head body at a location opposite to the offset direction of the head journal. The gage pad is fitted with inserts or hardfaced with wear resistant alloy to prevent bit from whirling and prevent head body from being worn out and to ensure gage protection. Junk slots are machined along the side of head body and jet ports are arranged at lower bevel of the head body to guarantee cuttings removal and effective cleaning results. This invention improves the bit's ability to break rocks through impact for specific use in hard formations. The bit performance is obviously improved and overall drilling cost reduced.

12 Claims, 12 Drawing Sheets

U.S. PATENT DOCUMENTS

| | | | | | |
|---|---|---|---|---|---|
| 3,982,596 | A * | 9/1976 | Vetter | 175/426 |
| 4,234,048 | A * | 11/1980 | Rowley | 175/430 |
| 4,267,893 | A * | 5/1981 | Mannon, Jr. | 175/65 |
| 4,967,854 | A * | 11/1990 | Barnetche-Gonzalez | 175/353 |
| 6,123,160 | A * | 9/2000 | Tibbitts | 175/385 |
| 6,206,117 | B1 * | 3/2001 | Tibbitts et al. | 175/399 |
| 2002/0112894 | A1 * | 8/2002 | Caraway | 175/385 |

FOREIGN PATENT DOCUMENTS

| | | | |
|---|---|---|---|
| CN | 2375759 | Y | 4/2000 |
| CN | 2460719 | Y | 11/2001 |
| CN | 2462065 | Y | 11/2001 |
| CN | 2375753 | Y | 2/2002 |
| EP | 0577545 | A1 * | 5/1994 |

* cited by examiner

ROLLER BIT WITH A JOURNAL PIN OFFSET FROM THE CENTRAL AXIS THEREOF

FIELD OF THE INVENTION

This invention relates to a single cone bit with offset axis and composite cones for oil and gas drilling, mining and other subterranean drilling operations. The bit performs in an excellent manner when drilling in hard formations.

BACKGROUND OF THE INVENTION

Conventional single cone bits normally consist of cone and head sections and the shape of the cone is mostly spherical or spherical with steps. A plurality of cutting elements is mounted onto the spherical surface. The head has a head body and a journal; the cone is mounted onto the head journal via its inner cavity for rotation around the journal and thus forms the bit. Gage pads are uniformly arranged on the cylindrical portion of the head, and the lower jet port in the head journal and the upper watercourse in the head body form the hydraulic structure of the bit. Such a single cone bit is a so-called full-hole bit and it breaks formation mainly by cutting. While the cone cuts bottom hole rock through rotating around the bearing, the cone surface also has a slip motion relative to the bottom of the hole, and such slip motion varies at different portions on the cone surface so that each insert of the cone moves along different tracks on bottom hole surface and cuts out a networked bottom hole pattern. Single cone bit of such structure drills steadily in soft to medium hard formations, but the inserts get wear fast and the bit performs unsatisfactory when used in hard formation. Extensive researches show that existing single cone bits are not suitable for drilling in hard formation with shear and slip rock breaking modes. Bit for drilling in hard formation must normally have the powerful impact ability to break formation rocks. Better drilling performance can only be obtained with the bit featuring abilities of impact, crush and scrape in minor spaces for rock breaking.

SUMMARY OF THE INVENTION

The principal object of the present invention is to provide a single cone bit with offset axis and composite cones with better impact ability to break formation rocks suitable for drilling in hard formations.

According to a preferred embodiment of the invention, a single cone bit with offset axis and composite cones is provided with cone and head body, a head journal is arranged at the lower end of the head body for rotatably connection with the cone, the cone section has a shape of composite cones, the outer circumference of the cone is composed of from back face of the cone to top of the cone an extended gage surface, an outer cone surface and a main cone surface, cutting elements are mounted onto each cone surfaces, and an offset value d is designed between the axis of head journal and the axis of the bit along rotating direction of the cone; A gage pad is arranged on head body at a location opposite to the offset direction of the head journal and the gage pad is fitted with gage inserts; Jet ports are arranged at the lower bevel of the head body.

According to the preferred embodiment of the present invention, generatrices of the said extended gage surface, outer cone surface and main cone surface can be straight line or curved.

According to the preferred embodiment of the present invention, the main cone surface is a negative cone surface, and the angle $\epsilon$ formed by generatrix of the main cone surface and centerline of the cone rotation is equal to or less than 90° (i.e. $\epsilon \leqq 90°$).

According to the preferred embodiment of the present invention, the extended gage surface can be step shaped.

According to the preferred embodiment of the present invention, the vertical height of the extended gage surface is 20 to 80 percent of the height of the cone section.

According to the preferred embodiment of the present invention, the back angle $\theta$ of said extended gage surface equals to 30° to 80°.

According to the preferred embodiment of the present invention, the offset value d is a distance the centerline of the head journal that offsets from the centerline of the bit and the offset value d is from to 1~10 mm.

According to the preferred embodiment of the present invention, wherein at least two jet ports are arranged at lower bevel of the head body, the left port is located at one side of the lower bevel of the head body, the angle $\beta$ between centerline of the left port and the longitudinal symmetrical plane in which the bit axis locates is equal to 10° to 30°, the centerline of the center port is within the longitudinal symmetrical plane and the angle $\alpha$ between it and axis of the head body is equal to 15° to 30°, back ends of both jet ports are connected with inlet hole in the head body.

According to the preferred embodiment of the present invention, the head journal is a mono-axis journal.

According to the preferred embodiment of the present invention, junk slots are machined along the side of the head body.

According to the preferred embodiment of the present invention, wherein the diameter of the outer circumference of the gage pad is 0.80~1.00 times the bit diameter.

According to the preferred embodiment of the present invention, the gage pad is mounted with gage inserts or is hardfaced with wear resistant alloy.

According to the preferred embodiment of the present invention, wherein junk slots with circular arc surface are arranged on head body at the side opposite to gage pad and the range of the radian of the junk slot is from 60° to 150°.

According to the preferred embodiment of the present invention, one or more junk slots are arranged at the side of the gage pad.

According to the preferred embodiment of the present invention, a single cone bit with offset axis and composite cones is provided with cone, head body, cutting elements, gage pad, gage inserts and junk slots, etc., a head journal is arranged at the lower end of the head body for rotatablely connection with the cone, the cone section has a shape of composite cones, an offset value d is designated between the axis of head journal and the axis of the bit along rotating direction of the cone and d equals from 10 mm to greater than 0 mm, and jet ports are arranged at lower bevel of the head body.

According to the preferred embodiment of the present invention, at least two jet ports arranged at lower bevel of the head body and back ends of the jet ports are all communicate with inlet hole in the head body.

OBJECTS OF THE INVENTION

During drilling, the single cone cutting structure formed by setting inserts onto composite cone surfaces can reduce the number of inserts that instantaneously contact the bottom hole, shorten each insert's slip distance on formation rock, feature the bit with abilities of impact, crush and scrape in minor spaces for rock breaking and forms near parabola bottom hole pattern, thus obviously improves the bit's performance and rate of penetration (ROP) and reduces overall drilling costs when the bit is used in medium hard and harder formations.

The offset of the head journal adds the cone an offset value along rotating direction of the cone during operation, which results an alteration of single cone bit's full hole drilling mechanism, enhances the bit's ability to break formation rocks by impact and improves the bit's performance in drilling hard formations.

The arrangement of gage pad at a location opposite to the offset direction of the head journal can effectively help the bit to anti whirl, prevent head body from wearing out, and also function as gage protection.

Jet ports arranged at lower bevel of the head body and junk slots machined at side of the head body ensure cuttings can be carried timely out of the borehole by drilling fluid, obtaining good cleaning and cutting removal results.

DESCRIPTION OF THE PREFERRED EMBODIMENTS

Figure 2:
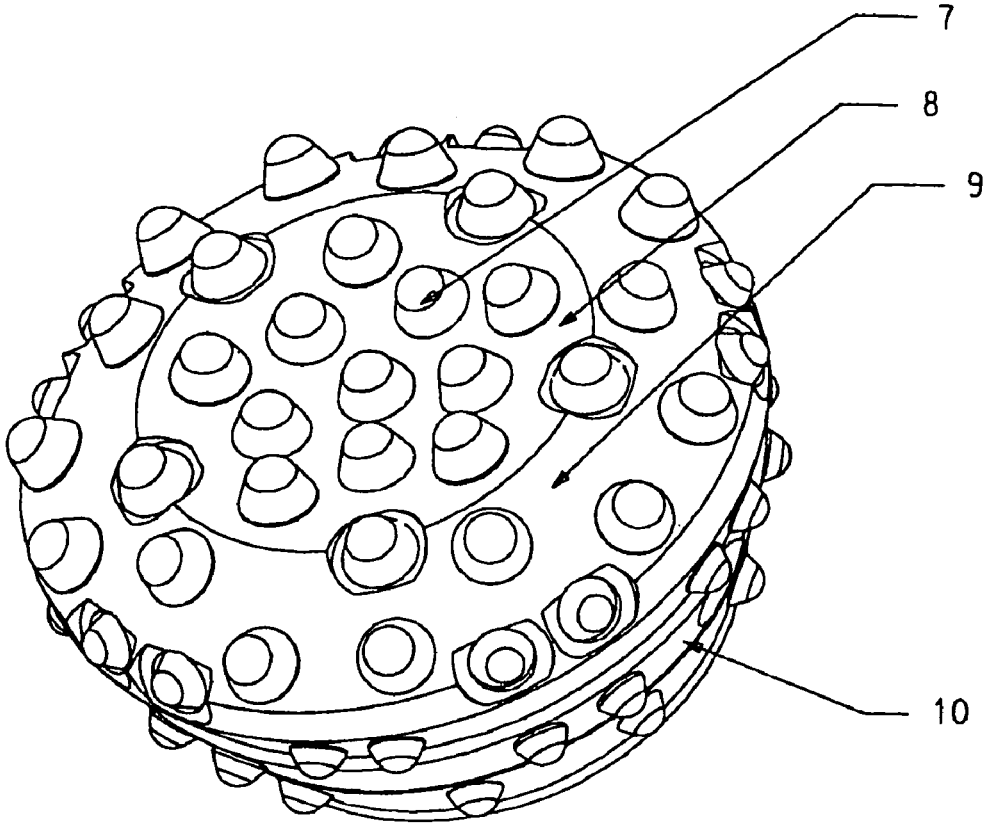
FIG. 2 is a solid view of the cone with composite cone surfaces according to one of the embodiments of the present invention.
Figure 3:
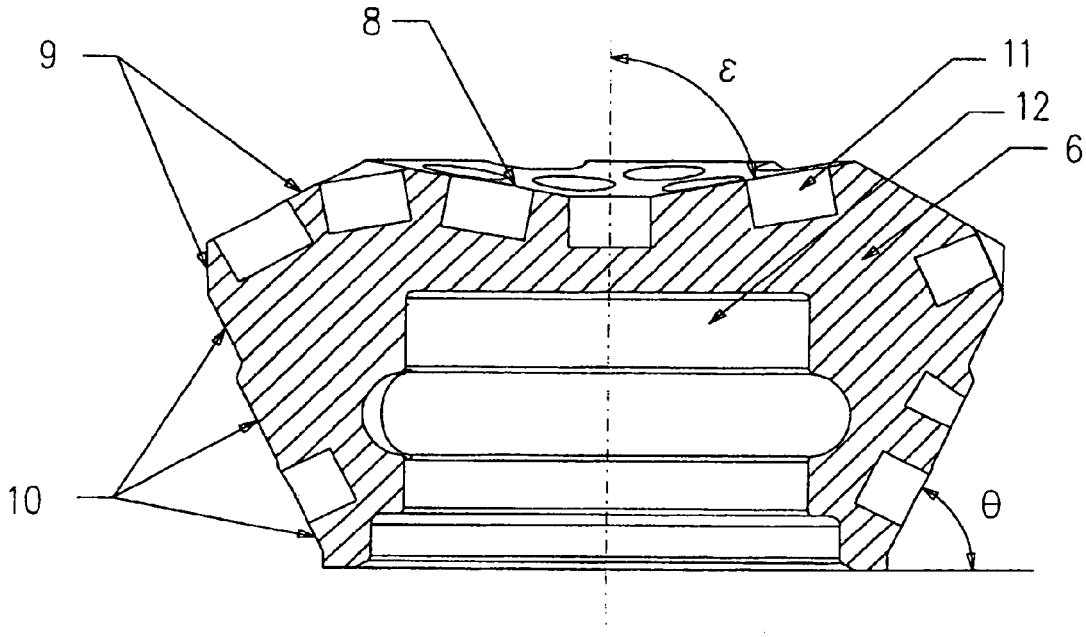
FIG. 3 is a front sectional view of the cone with composite cone surfaces according to one of the embodiments of the present invention.

The preferred embodiment is a single cone bit with offset axis and composite cones. See FIGS. 1, 3, 4, 5 and 6, in which the bit comprises head body 4 and cone 6. Head body 4 is fitted with cone via head journal 13 at the lower part of the head in cone ID 12. Between the axis of head journal 13 and the axis of the bit, there is an offset value d along the rotating direction of cone 6. The said offset value d is a distance the centerline of the head journal that offset from the centerline of the bit and the range of d equals from 1~10 mm. Normally, the range of d is from 2 to 6 mm. The head journal 13 is a mono-axis journal. The head bearing consists of sealing surface 15 and ball lock groove 16, etc. The cone 6 that mounted onto head journal 13 has a shape of composite cones; see FIGS. 2 and 3 for its outer profile. The outer circumference of the cone 6 is composed of from back face of the cone to top of the cone the extended gage surface 10, outer cone surface 9 and main cone surface 8 so that the cone 6 has a composite cone profile. A plurality of cutting elements 7 is mounted onto each cone surface. The said main cone surface 8 is a negative cone surface, i.e. the angle $\epsilon$ formed by generatrix of the main cone surface 8 and centerline of the rotation of cone 6 is equal to or less than 90° (i.e. $\epsilon \leqq 90°$). The back angle $\theta$ of the extended gage surface 10 equals to 30° to 80°. The extended gage surface 10 can be step shaped, and the vertical height of the extended gage surface 10 is 20 to 80 percent and normally 40 to 80 percent of the height of cone 6. The generatrices of the the extended gage surface 10, outer cone surface 9 and main cone surface 8 can be a straight line or a curve. Insert (compact) holes 11 are drilled on extended gage surface 10, outer cone surface 9 and main cone surface 8 of the cone 6 and inserts 7 are mounted in insert holes 11. Multiple rows of staggered inserts 7 are mounted onto extended gage surface 10. Inserts 7 are conical carbide inserts or polycrystalline diamond compacts. Cone 6 is mounted onto the head journal 13 via its bearing cavity 12.

Figure 1:
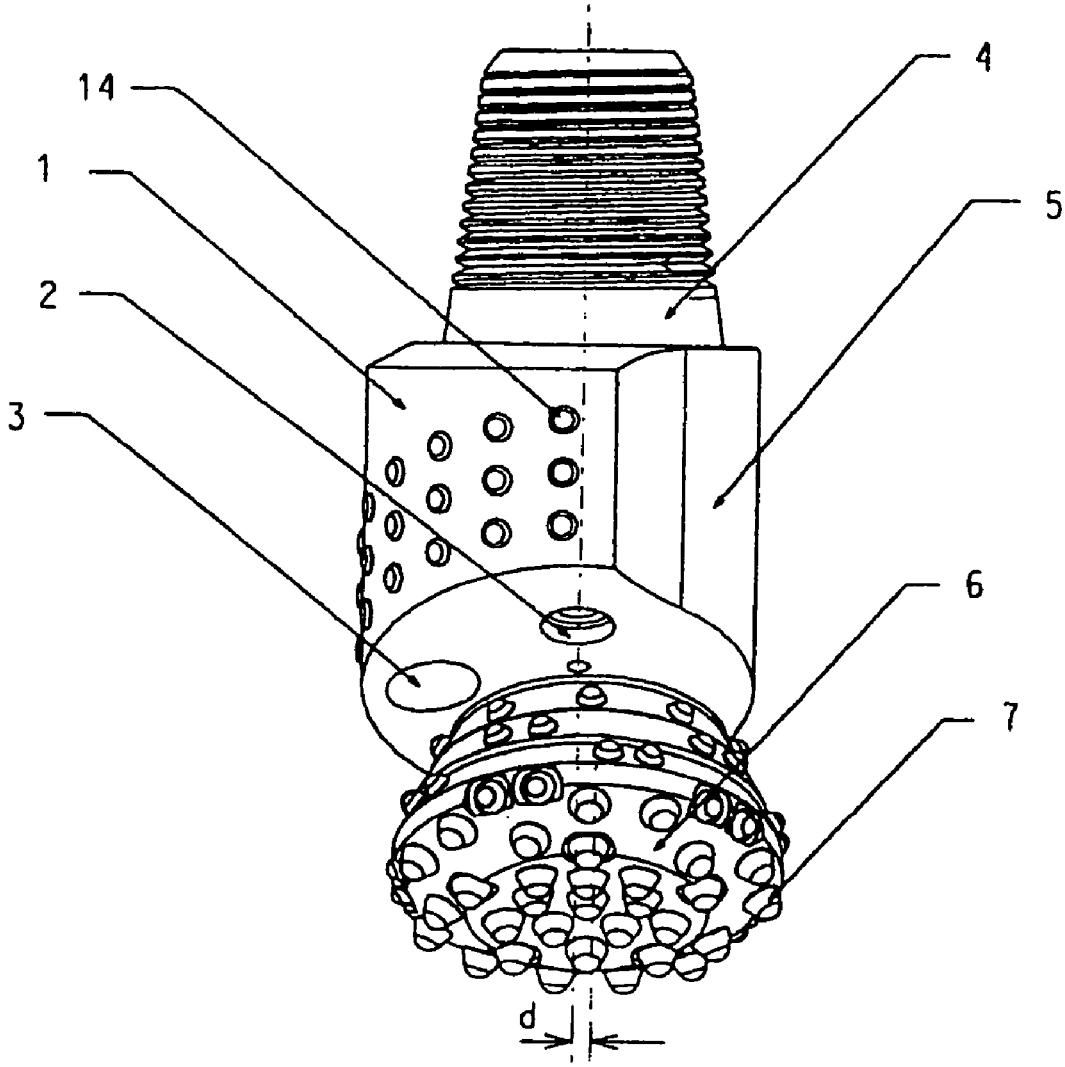
FIG. 1 is a front view of the single cone bit with offset axis and composite cones according to one of the embodiments of the present invention.
Figure 4:
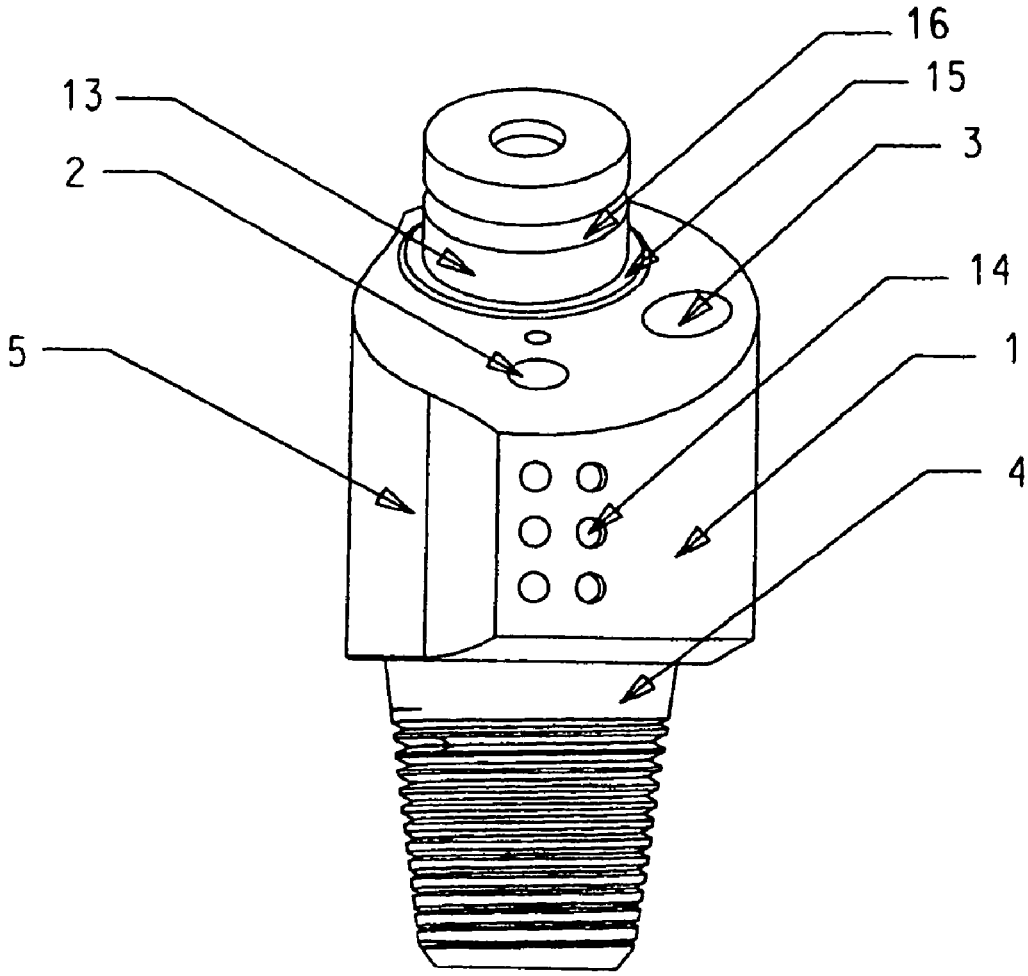
FIG. 4 is a front view of the head body according to one of the embodiments of the present invention.
Figure 5:
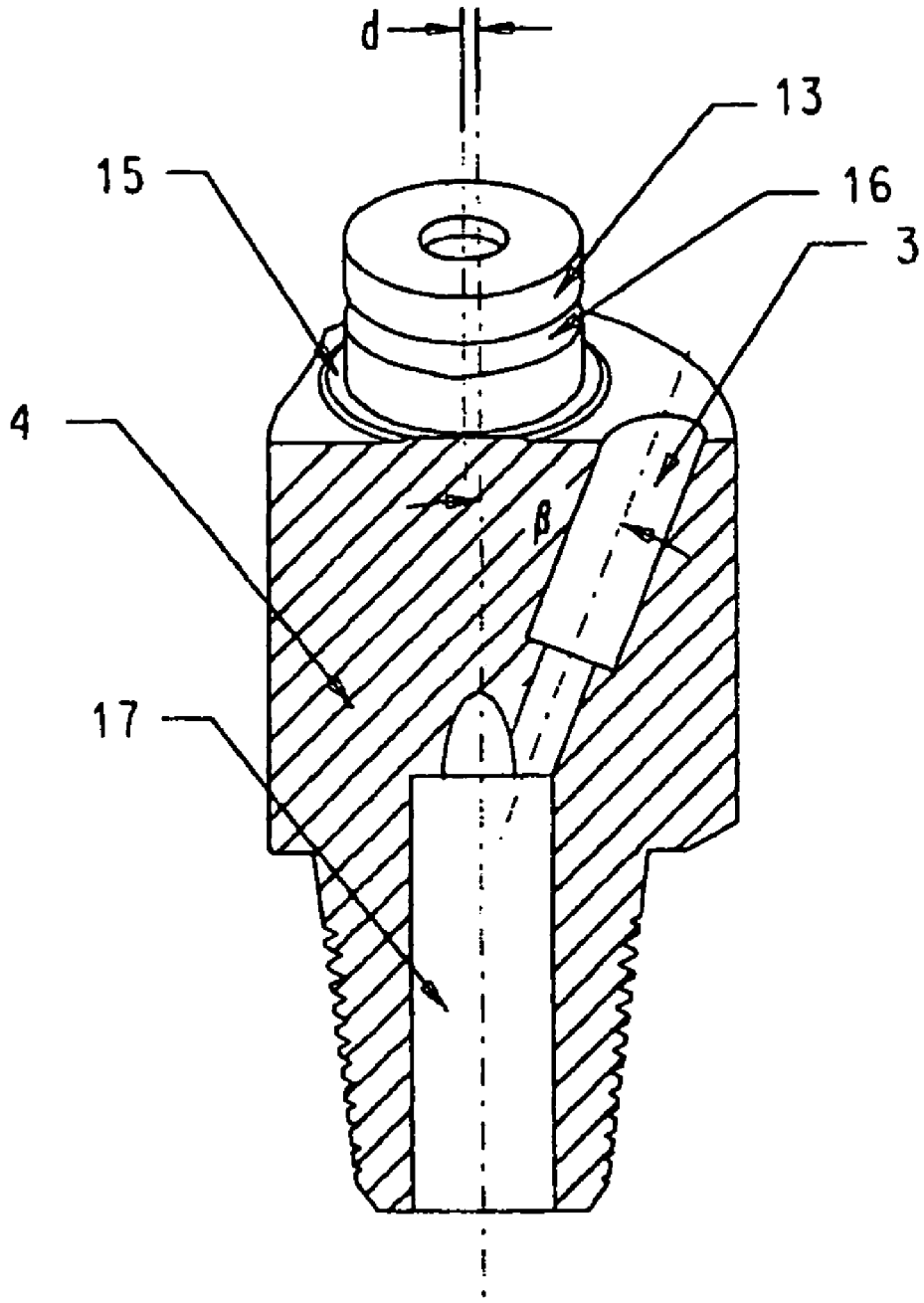
FIG. 5 is a cutaway view showing left jet port of the head body and offset distance d of the head bearing according to one of the embodiments of the present invention.
Figure 6:
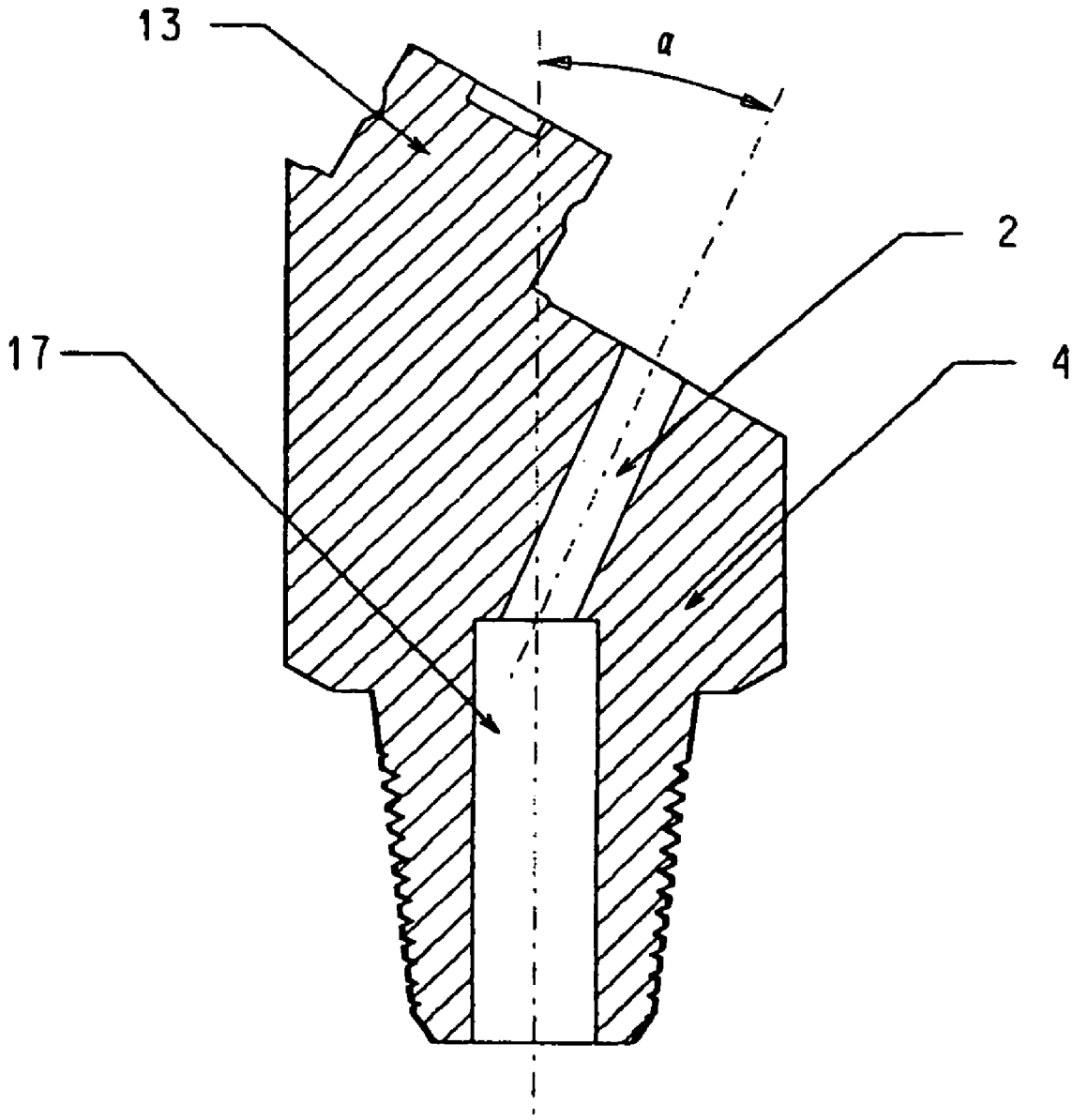
FIG. 6 is a longitudinal symmetric sectional view of the head body showing center jet port according to one of the embodiments of the present invention.
Figure 7:
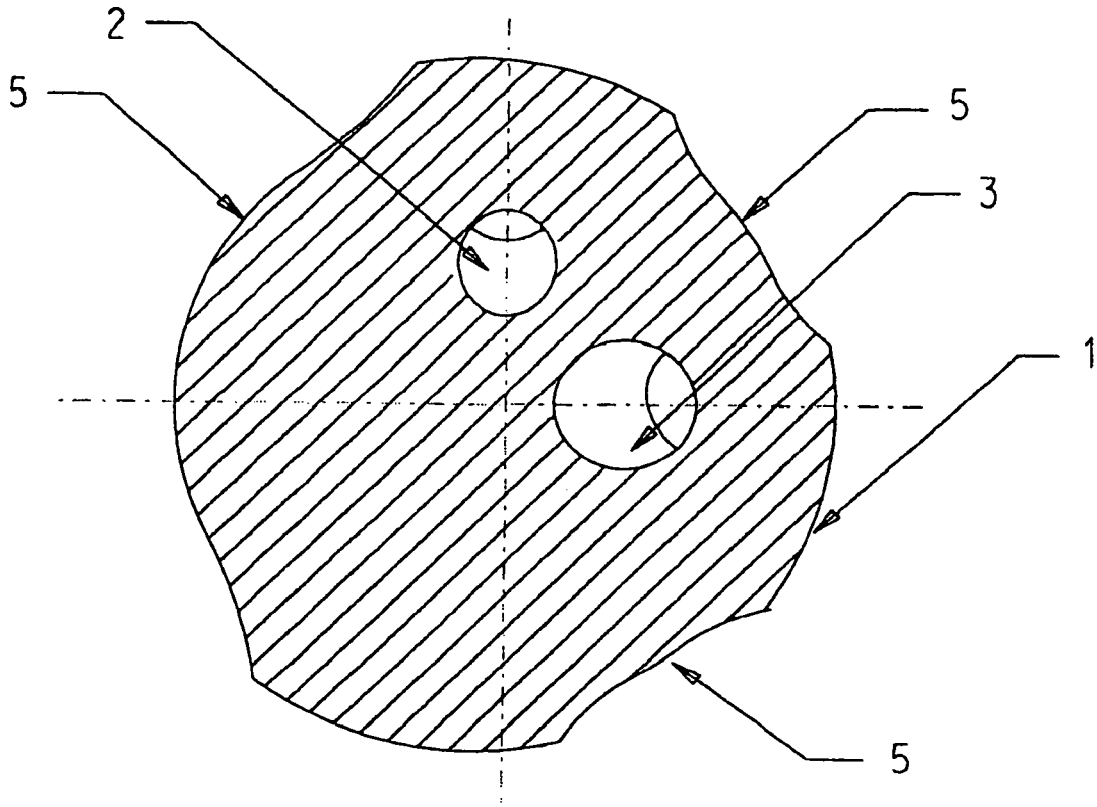
FIG. 7 is a cross sectional view of the head body showing three junk slots according to one of the embodiments of the present invention.
Figure 8:
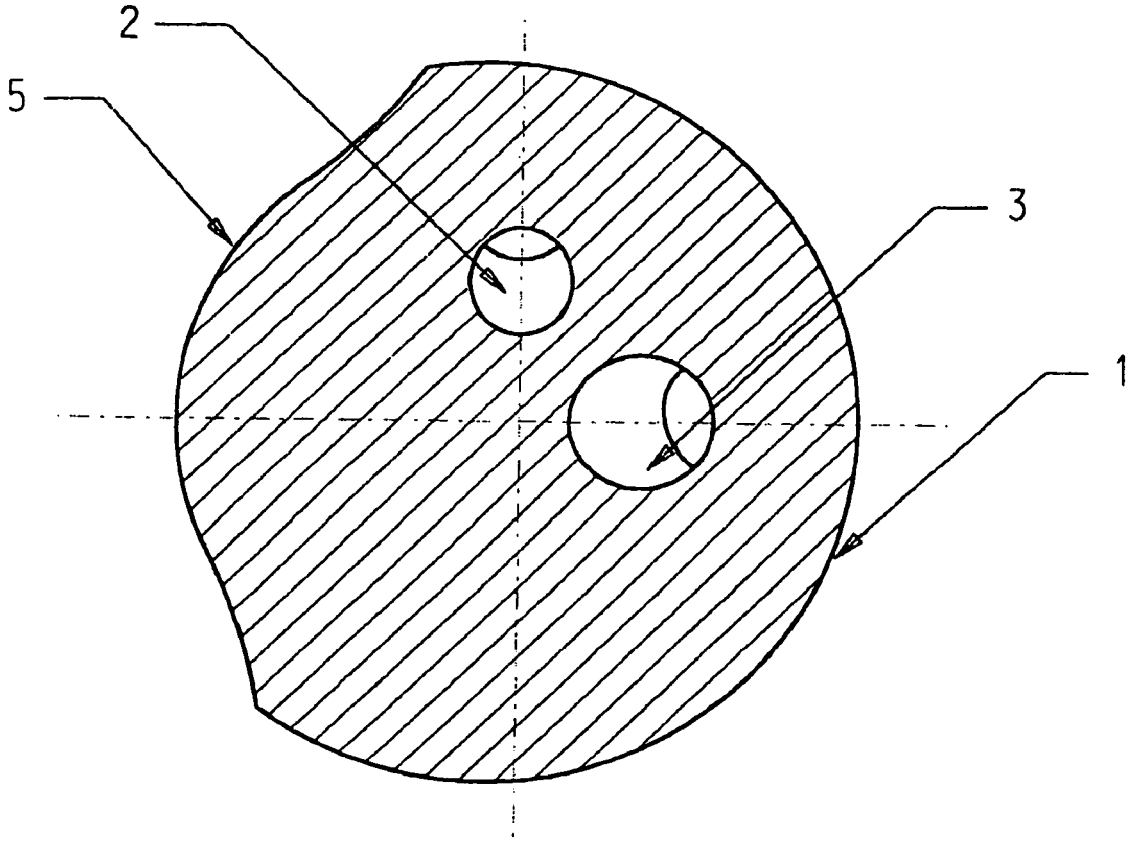
FIG. 8 is a cross sectional view of the head body showing one junk slot according to one of the embodiments of the present invention.

See FIGS. 1 and 4, an anti-whirl gage pad 1 is arranged on head body 4 at a location opposite to the offset direction of the head journal 13 and the diameter of the outer circumference of said gage pad is 0.80~1.00 times of the bit diameter. The gage pad 1 is mounted with gage inserts 14 or hardfaced with wear resistant alloy. Gage inserts 14 are flat-topped inserts or polycrystalline diamond compacts. Junk slots 5 with circular arc surface are arranged on head body 4 at the side opposite to gage pad 1 and the range of the radian of junk slot 5 is from 60° to 150°. Depending on specific designs, one or more junk slots 5 can be arranged at the side of gage pad 1. In addition, two jet ports are arranged at the lower bevel of head body 4 (see FIGS. 1, 4, 5, 6, 7 and 8) among which the left jet port 3 is at one side of the lower bevel of head body 4 and the angle $\beta$ between centerline of the left port 3 and the longitudinal symmetrical plane in which the bit axis locates is equal to 10° to 30°, the centerline of the center port 2 is within the longitudinal symmetrical plane and the angle $\alpha$ between it and axis of the head body 4 is equal to 15° to 30°, back ends of both jet ports are connected with inlet hole 17 in the head body 4.

Figure 9:
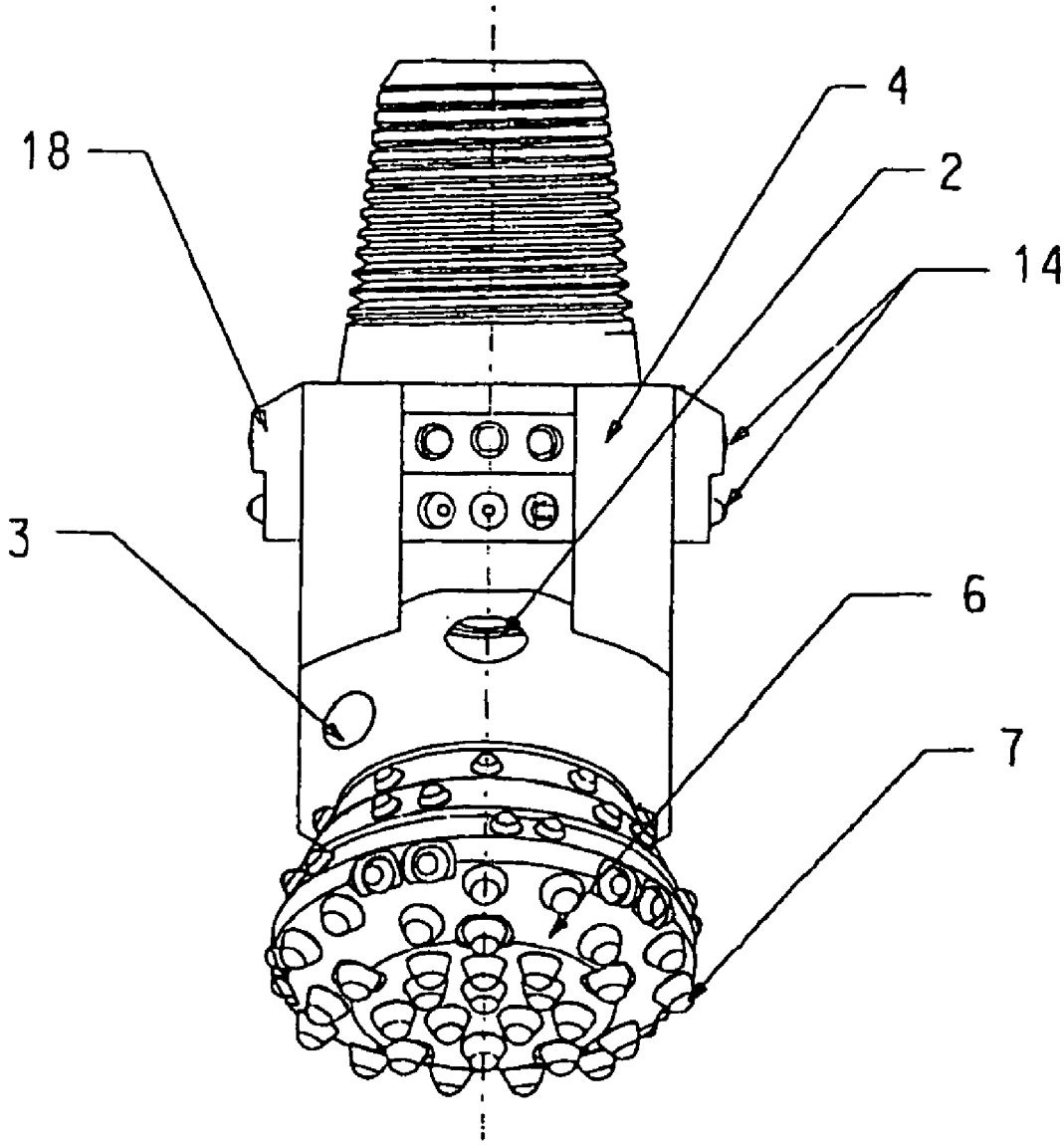
FIG. 9 is a front view of the single cone bit with offset axis and composite cones according to another embodiment of the present invention.
Figure 10:
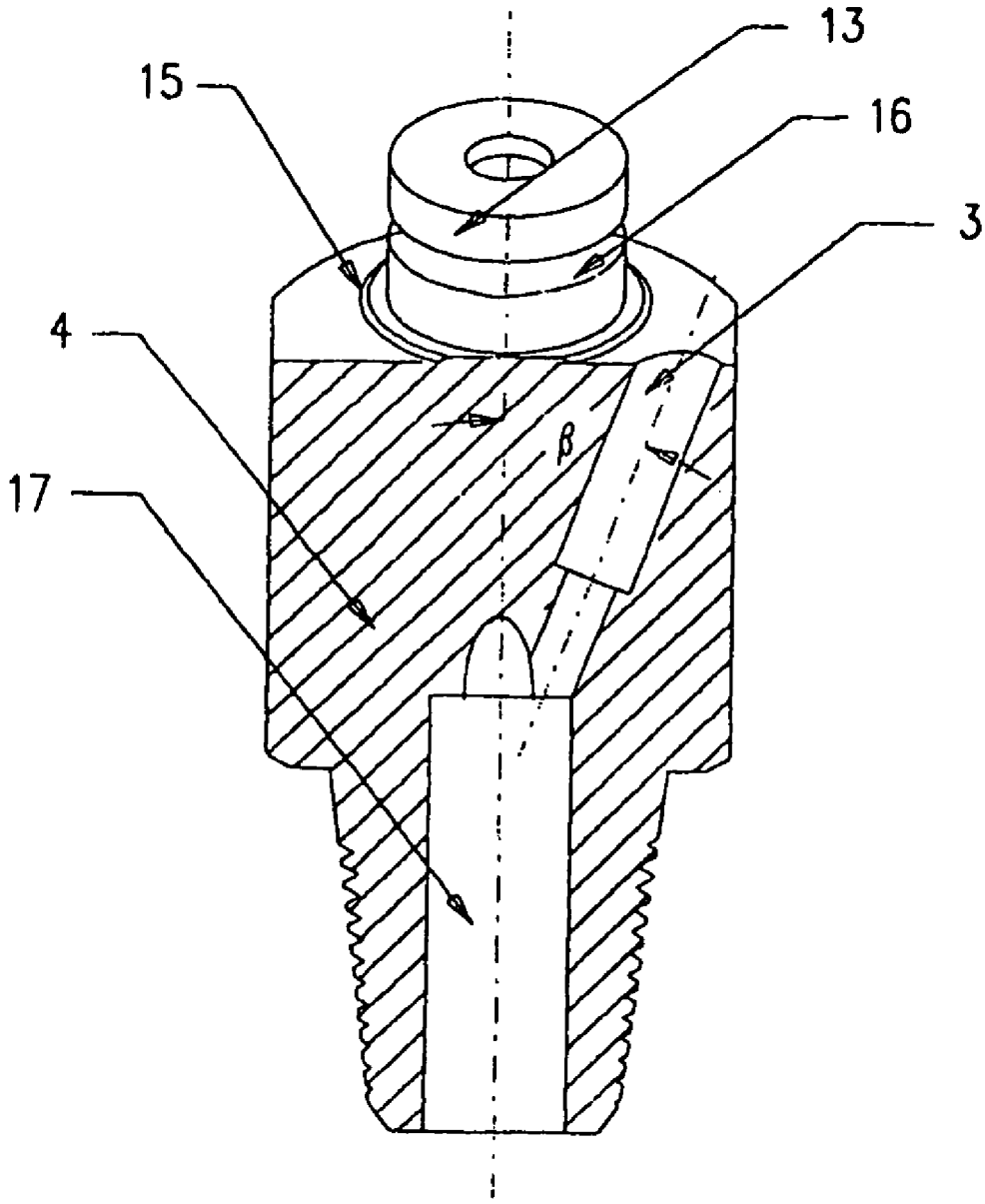
FIG. 10 is a front sectional view of the head body showing the left jet port according to another embodiment of the present invention.
Figure 11:
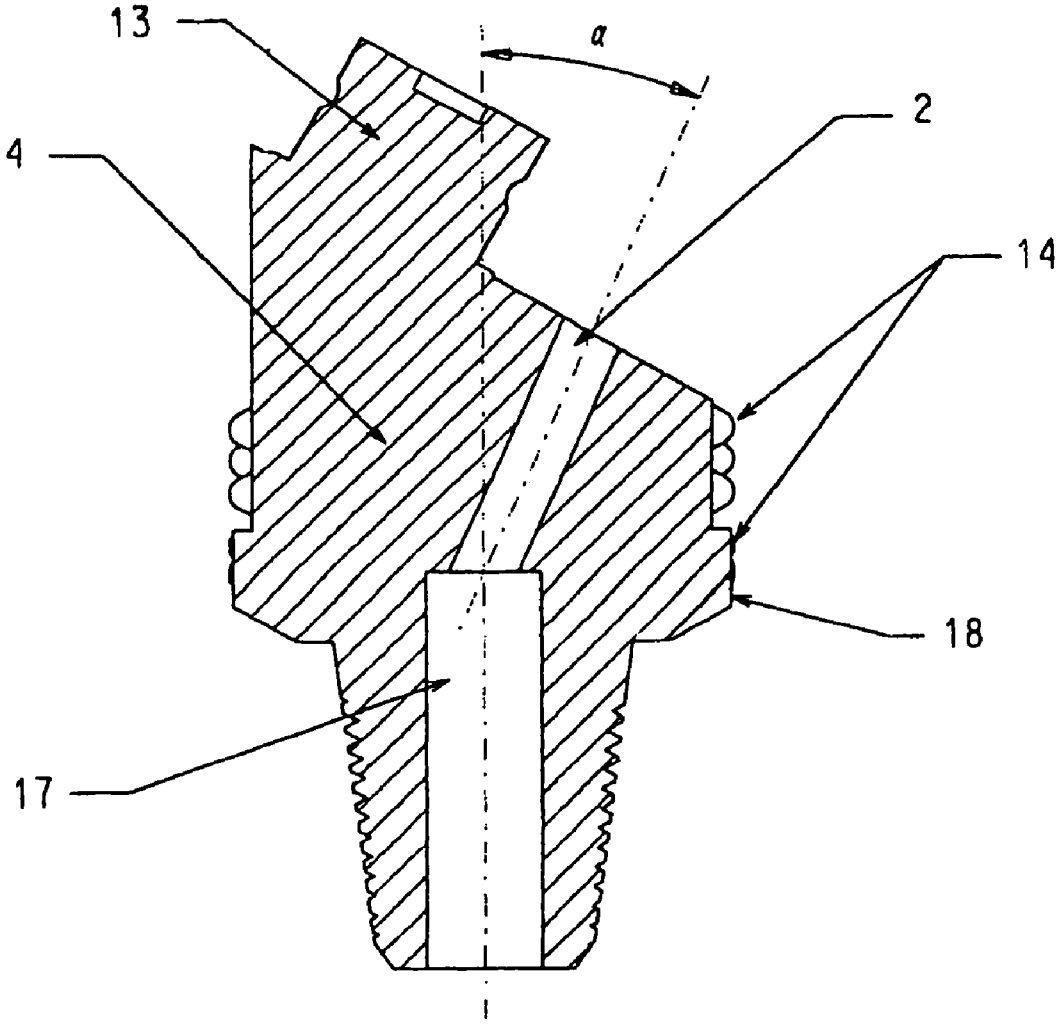
FIG. 11 is a longitudinal symmetric sectional view of the head body showing center jet port according to another embodiment of the present invention.
Figure 12:
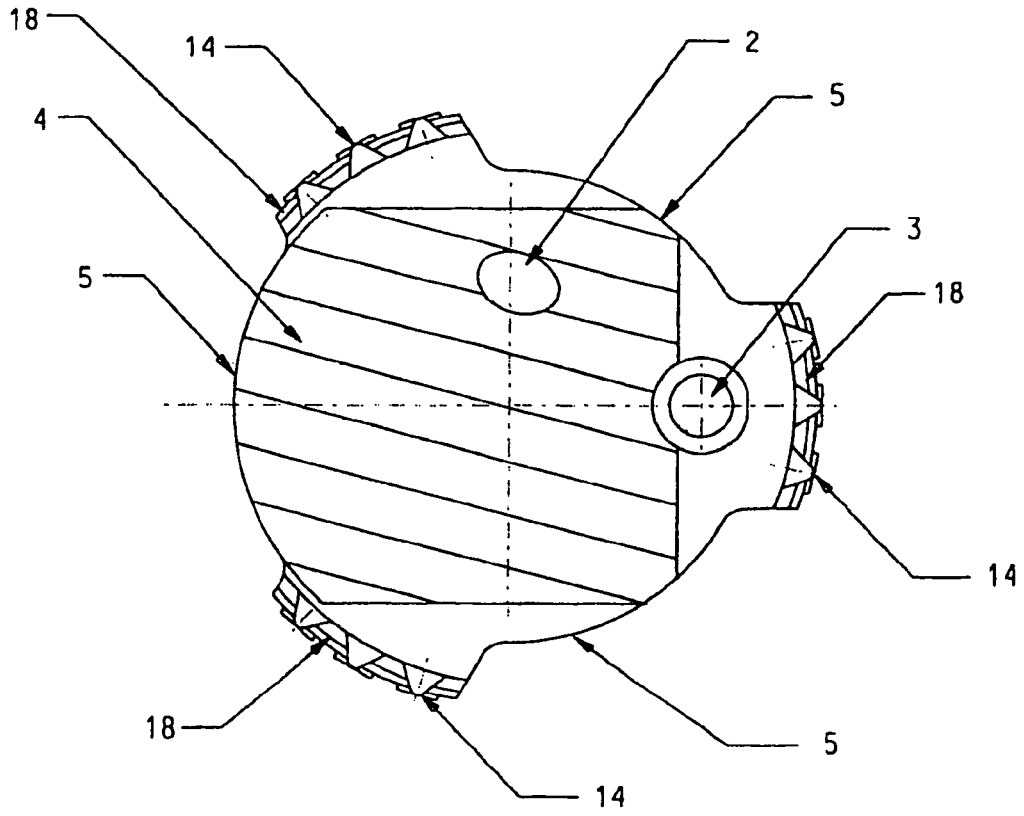
FIG. 12 is a cross sectional view of the head body showing uniformly distributed junk slots, gage pad and gage inserts according to another embodiment of the present invention.

The preferred embodiment B is a single cone bit with composite cones but without offset axis. To be more specific, the axis of head journal 13 is overlapped with the axis of the bit in this embodiment (see FIGS. 9 and 10).

See FIGS. 3, 9, 10, 11 and 12, which shows head body 4, cone 6, cutting elements 7, gage pad 18, gage inserts 14 and junk slots 5, etc. Head body 4 is fitted with cone via head journal 13 at the lower part of the head in cone ID 12. The axis of head journal 13 is overlapped with the axis of the bit. The head journal 13 is a mono-axis journal. The head bearing consists of sealing surface 15 and ball lock groove 16, etc. The cone 6 that mounted onto head journal 13 has a shape of composite cones; see FIGS. 2 and 3 for its outer profile. The outer circumference of the cone 6 is composed of from back face of the cone to top of the cone the extended gage surface 10, outer cone surface 9 and main cone surface 8 so that the cone 6 has a composite cone profile. A plurality of cutting elements 7 is mounted onto each cone surface. The said main cone surface 8 is a negative cone surface, i.e. the angle $\epsilon$ formed by generatrix of the main cone surface 8 and centerline of the rotation of cone 6 is equal to or less than 90° (i.e. $\epsilon \leqq 90°$). The back angle $\theta$ of said extended gage surface 10 is from 30° to 80°. The extended gage surface 10 can be step shaped, and the vertical height of said extended gage surface 10 is 20 to 80 percent and normally 40 to 80 percent of the height of cone 6. The generatrices of the said extended gage surface 10, outer cone surface 9 and main cone surface 8 can be straight line or curve. Insert (compact) holes 11 are drilled on extended gage surface 10, outer cone surface 9 and main cone surface 8 of the cone 6 and inserts 7 are mounted in insert holes 11. Multiple rows of staggered inserts 7 are mounted onto extended gage surface 10. Inserts 7 are conical carbide inserts or polycrystalline diamond compacts. Cone 6 is mounted onto the head journal 13 via its bearing cavity 12.

In addition, at least two jet ports are arranged at the lower bevel of head body 4 (see FIGS. 9, 10, 11 and 12) among which the left jet port 3 is at one side of the lower bevel of head body 4, left jet port 3 can be one or more, and the angle $\beta$ between centerline of the left port 3 and the longitudinal symmetrical plane in which the bit axis locates is from 10° to 30°, the centerline of the center port 2 is within the longitudinal symmetrical plane and the angle $\alpha$ between it and axis of the head body 4 is from 15° to 30°, back ends of jet ports are all connected with inlet hole 17 in the head body 4. Junk slots 5, gage pad 18 and gage inserts 14 are uniformly arranged on the cylindrical portion of the head body.

What is claimed is:

1. A single cone bit with offset axis and composite cones, the single cone bit comprising:

a head body and a cone;

a head journal at lower end of the head body for rotatablely connection with the cone;

said cone section having a shape of composite cones, wherein the outer circumference of the cone is composed of from a back face of the cone to a top of the cone an extended gage surface, an outer cone surface and a main cone surface, forming the cone section in a shape of composite cones, a plurality of cutting elements mounted onto each cone surface, the said main cone surface having a negative cone surface, and an angle $\epsilon$ formed by generatrix of the main cone surface and centerline of the cone rotation being equal to or less than 90° (i.e.$\epsilon \leqq 90°$), the axis of the bit being offset from the axis of the cone and head journal, wherein;

a gage pad arranged on a side of head body opposite to the offset direction of the head journal, the opposite side of the gage pad provided with the junk slots, and jet ports arranged at a lower bevel of the head body.

2. The single cone bit with offset axis and composite cones according to claim 1 wherein the generatrices of the said extended gage surface can be step or curved shaped.

3. The single cone bit with offset axis and composite cones according to claim 1 wherein the vertical height of said extended gage surface is 20 to 80 percent of the height of the cone section.

4. The single cone bit with offset axis and composite cones according to claim 1 wherein a back angle $\theta$ of said extended gage surface is from 30° to 80°.

5. The single cone bit with offset axis and composite cones according to claim 1 wherein an offset value d is a distance between the centerline of the head journal and the centerline of the bit, and wherein $10 \geqq d > 0$ mm.

6. The single cone bit with offset axis and composite cones according to claim 1 wherein the diameter of the outer circumference of said gage pad is 0.80~1.00 times the bit diameter.

7. The single cone bit with offset axis and composite cones according to claim 1 wherein junk slots having a circular arc surface are arranged on the head body at each side opposite to gage pad and the range of the radian of the junk slot is from 60° to 150°.

8. The single cone bit with offset axis and composite cones according to claim 1 wherein the said gage pad is fitted with carbide inserts or hardfaced with wear resistant alloy.

9. The single cone bit with offset axis and composite cones according to claim 1 wherein at least two jet ports are arranged at the lower bevel of the head body, a first port being located at a central plane of an head body, the angle $\beta$ between the centerline of said first port and the longitudinal symmetrical plane in which the bit axis locates is from 10° to 30°, the centerline of a second port being within the longitudinal symmetrical plane and an angle $\alpha$ between the centerline of said second port and axis of the head body is from 15° to 30°, and back ends of both jet ports in communication with an inlet hole in the head body.

10. A single cone bit with composite cones, which comprises:

a head body;

a cone;

cutting elements;

gage pad;

gage inserts and junk slots;

said head body being fitted with a cone via head journal at the lower part of the head;

the outer circumference of the cone being composed of from a back face of the cone to a top of an cone, the extended gage surface, outer cone surface and main cone surface, so that the cone has a composite cone profile, a plurality of cutting elements being mounted onto each cone surface;

junk slots, the gage pad and the gage inserts being uniformly arranged on a cylindrical portion of the head body;

wherein the axis of head journal coincide with the axis of the bit.

11. A single cone bit with composite cones according to claim 10, wherein at least two jet ports are arranged at a lower bevel of the head body.

12. A single cone bit with composite cones according to claim 10, wherein the angle formed by generatrix of the main cone surface and centerline of rotation of the cone is equal to or less than 90°, and a back angle of said extended gage surface is from 30° to 80°.

* * * * *